US005820532A

United States Patent [19]

Oliver

[11] Patent Number: 5,820,532

[45] Date of Patent: Oct. 13, 1998

[54] PORTABLE ARM AND LEG EXERCISER

[76] Inventor: Carlos P. Oliver, 955 W. St. Clair Ave., Apt. 512, Cleveland, Ohio 44113

[21] Appl. No.: 877,367

[22] Filed: Jun. 17, 1997

[51] Int. Cl.[6] ..... A63B 21/02

[52] U.S. Cl. ..... 482/123; 482/121; 482/126; 482/129; 482/130; 482/142; 482/904

[58] Field of Search ..... 482/129, 130, 482/904, 121, 122, 123, 126, 142

[56] References Cited

U.S. PATENT DOCUMENTS

| | | | |
|---|---|---|---|
| 3,826,490 | 7/1974 | Mossman | 482/130 |
| 4,090,706 | 5/1978 | Reda . | |
| 4,198,044 | 4/1980 | Holappa | 482/130 |
| 4,403,773 | 9/1983 | Swann | 482/130 |
| 4,492,376 | 1/1985 | Schatz et al. | 482/130 |
| 4,872,671 | 10/1989 | Brandell . | |
| 5,029,850 | 7/1991 | van Straaten . | |
| 5,160,303 | 11/1992 | Smith . | |
| 5,160,306 | 11/1992 | Lui | 482/904 |
| 5,232,425 | 8/1993 | Miller . | |
| 5,405,305 | 4/1995 | Wilkinson . | |
| 5,417,636 | 5/1995 | Havens . | |
| 5,468,205 | 11/1995 | McFall . | |
| 5,476,431 | 12/1995 | Wilkinson . | |

*Primary Examiner*—Lynne A. Reichard
*Attorney, Agent, or Firm*—D. Peter Hochberg

[57] ABSTRACT

A portable arm and leg exerciser (10) has a board (12) having a board upper end (12U) and a board bottom end (12B). The board (12) has at least one opening positioned in the board upper end (12U). The arm and leg exerciser (10) further has an exerciser (14) which comprises at least one exerciser elastic member (14A) securely fastened on one distal end through the at least one opening to the board (12). The exerciser (14) further comprises an exerciser grip (14B, 14C) fastened to the opposite end of the at least one exerciser elastic member (14A). A user (16) inserts the board bottom end (12B) of the board (12) between a bed mattress (18A) and a bed box spring (18B) of a bed (18). To exercise a user's arm and upper body (16A), the user (16) sits on the bed mattress (18A) over the board (12) and securely holds an exerciser hand grip (14C) moving in an upward direction to tension the exerciser elastic member (14A) and moving in a downward direction to release tension from the exerciser elastic member (14A). To exercise a user's leg and lower body (16B), the user (16) lays down on the bed mattress (18A) over the board (12) and securely affixes an exerciser ankle grip (14B) moving in an upward direction to tension the exerciser elastic member (14A) and moving in a downward direction to release tension from the exerciser elastic member (14A).

14 Claims, 3 Drawing Sheets

PORTABLE ARM AND LEG EXERCISER

BACKGROUND OF THE INVENTION

1. Field of the Invention

The present invention relates to exercise equipment. More particularly, the present invention relates to portable exercise equipment for home and travel use.

2. Description of the Prior Art

The use of portable exercise equipment increases in demand as the awareness of the relationship of exercise to general health has become well known. This relationship has created a demand for exercise equipment which is easier to use and requires little storage space. Initially exercise equipment was solely found in health clubs and fitness centers, however, as the public has become more educated about exercise and general health, an individual can be just as capable of prescribing an exercise program for himself as is a health professional. This has resulted in the demand for home exercise equipment which is affordable, versatile and effective.

Numerous innovations for Portable Arm and Leg Exerciser have been provided in the prior art that are described as follows. Even though these innovations may be suitable for the specific individual purposes to which they address, they differ from the present invention as hereinafter contrasted.

In U.S. Pat. No. 5,468,205, titled Portable Door Mounted Exercise Apparatus, invented by Michael McFall and Paul Aagaard, an exercise apparatus is disclosed having a pair of pulley support units mounted on a door by straps which vertically encircle the door. The support units are interconnected by a series of elastic bands, such as bungee cords that run vertical paths between the support units. The ends of the bands or cords are wrapped around pulleys and terminated such that a handle may be attached to the cords at either the top unit or the bottom unit. Various exercises are possible with one or two arms or legs by pulling on the cords with the handle. The apparatus is easily mounted or dismounted from any door or other vertically oriented and fixed-in-place partition and is small enough to fold and store in a small carrying case.

The patented invention differs from the present invention because the patented invention is an exercise apparatus having a pair of pulley support units mounted on a door by straps. The patented invention is secured to a door and functions in a vertical attitude. The patented invention has a pair of pulleys which guide an elastic means to a user. The device is not portable easily. The present invention is an exercise device having a base with either two or three holes, spaced closely. An elastic device with two ends is threaded through the holes in such a way that the elastic is not easily pulled through the holes and the end exit on an opposite side of the base, yet allows for easy adjustment. A grip handle is securely attached to one end. A padded loop is securely attached to the other end. The elastic device functions as a variable opposing force to a user. The user places the base of the exercise device between the spring and mattress of a bed to secure it.

In U.S. Pat. No. 5,476,431, titled Resistance Apparatus for Exercise Equipment, invented by William T. Wilkinson and Ford B. Draper, an improved cycling apparatus is provided wherein the improvement comprises at least one elastic band, one end of which is affixed to the cycling apparatus at a desired location, the other end of the elastic band providing resistive force against exertion upon the band by one extremity of a user of the cycling apparatus. In a preferred embodiment, the cycling apparatus includes two elastic bands, one end of each elastic band being affixed to the frame of the apparatus, the other end of each elastic band having a handle gripping means affixed thereto for gripping by the hands of the user. The bands provide resistive force against exertion upon these bands by the arms and hands of the user of the apparatus, thereby providing simultaneous, vigorous exercise for the arms, hands and upper body, as well as for the legs and lower body. In alternate embodiments, improved stair/step climbing and treadmill apparatus are provided, the improvement comprising at least one elastic band, one end of the elastic band being affixed to the apparatus at a desired location, the other end of the elastic band having a handle gripping means affixed thereto for gripping by a hand of the user. Two elastic bands are preferred, one for each hand of the user. The band provide resistive force against exertion upon the band by the arms and hands of the user of the apparatus resulting in simultaneous, vigorous exercise for both upper and lower body.

The patented invention differs from the present invention because the patented invention is a device for exercising the arms and upper body while using a treadmill or stationary bicycle. The patented invention lacks the feature of a base, a grip handle and a padded loop. The present invention is an exercise device having a base with either two or three holes, spaced closely. An elastic device with two ends is threaded through the holes in such a way that the elastic is not easily pulled through the holes and the end exit on an opposite side of the base, yet allows for easy adjustment. A grip handle is securely attached to one end. A padded loop is securely attached to the other end. The elastic device functions as a variable opposing force to a user. The user places the base of the exercise device between the spring and mattress of a bed to secure it.

In U.S. Pat. No. 5,417,636, titled Body Stretching and Exercise Mat System, invented by Suzanne Havens, a body exercising and stretching mat having a resilient surface is provided. The mat folds into several sections along a hinge line for easy storage. The mat has a plurality or stations arranged on the mat. One or more handles or grips may be selectively inserted into the stations. The user sits on the mat and reaches outwardly to grasp the handles to provide stability and to provide a progressive measure of exercise progress. The mat may also be used with a toe bar which is positionable to assist the user in doing other types of exercises such as sit-ups. Elastic bands may be attached to either the toe bar or at selected stations for additional stretching and exercising capability.

The patented invention differs from the present invention because the patented invention is padded base with attachment stations for grips and elastic devices. The patented invention functions with the mass of the user to keep it from moving while the user is exercising. The patented invention lacks the feature of small size. It functions with the user out of bed. The patented invention further, has a seat. The present invention is an exercise device having a base with either two or three holes, spaced closely. An elastic device with two ends is threaded through the holes in such a way that the elastic is not easily pulled through the holes and the end exit on an opposite side of the base, yet allows for easy adjustment. A grip handle is securely attached to one end. A padded loop is securely attached to the other end. The elastic device functions as a variable opposing force to a user. The user places the base of the exercise device between the spring and mattress of a bed to secure it.

In U.S. Pat. No. 5,405,305, titled Resistance Apparatus for Exercise Equipment, invented by William T. Wilkinson and Ford B. Draper, Jr., improved cycling apparatus is provided wherein the improvement comprises at least one elastic band, one end of which is affixed to the cycling apparatus at a desired location, the other end of the elastic band providing resistive force against exertion upon the band by one extremity of a user of the cycling apparatus. In a preferred embodiment, the cycling apparatus includes two elastic bands, one end of each elastic band being affixed to the frame of the apparatus, the other end of each elastic band having handle grips affixed thereto for gripping by the hands of the user. The bands provide resistive force against exertion upon these bands by the arms and hands of the user of the apparatus, thereby providing simultaneous, vigorous exercise for the arms, hands and upper body, as well as for the legs and lower body. In alternate embodiments, improved stair/step climbing and treadmill apparatus are provided, the improvement comprising at least one elastic band, one end of the elastic band being affixed to the apparatus at a desired location, the other end of the elastic band having handle grips affixed thereto for gripping by a hand of the user. Two elastic bands are preferred, one for each hand of the user. The bands provide resistive force against exertion upon the band by the arms and hands of the user of the apparatus resulting in simultaneous, vigorous exercise for both upper and lower body.

The patented invention differs from the present invention because the patented invention is a device for exercising the arms and upper body while using a treadmill or stationary bicycle. The patented invention lacks the feature of a base, a grip handle and a padded loop. The present invention is an exercise device having a base with either two or three holes, spaced closely. An elastic device with two ends is threaded through the holes in such a way that the elastic device is not easily pulled through the holes and the end exit on an opposite side of the base, yet allows for easy adjustment. A grip handle is securely attached to one end. A padded loop is securely attached to the other end. The elastic device functions as a variable opposing force to a user. The user places the base of the exercise device between the spring and mattress of a bed to secure it.

In U.S. Pat. No. 5,232,425, titled Pivotable Abdominal Exercise Device, invented by Jack V. Miller and Ned Gvoich, a device is described for exercising the abdominal muscles which facilitates movement of the lower torso against a resistive force and in a complex arc which conforms to the normal forward arc of rotation of the spine comprising: a rigid shaft slidably disposed within a housing; arcuate thigh supports for maintaining the housing stationary with respect to a person's thighs; a handle generally transverse to and attached to a first shaft end; an elastic band positioned intermediate the ends of the shaft and for connecting the housing to a second shaft end so as to generate a resistive force by pressing on the handle so as to displace the shaft relative to the housing in a direction form the first shaft end to the second shaft end, thereby executing a downstroke; a pivot positioned intermediate the ends of the shaft and for pivoting the upper portion of the shaft away from the torso as a downstroke is executed; a stop member for limiting displacement of the shaft with respect to the housing as the shaft moves in a direction from the second shaft end to the first shaft end, as an upstroke is completed; and a plurality of elastic bands for altering the amount of resistive restoring force.

The patented invention differs from the present invention because the patented invention is a device for exercising the abdominal muscles only. The patented invention has no features similar to the present invention.

In U.S. Pat. No. 5,160,303, titled Elastic Resistance Exercise Device having Resistance Element Retaining Structure, invented by Alvin H. Smith, a compact and easily adjusted exercising device useful for exercising the upper arms, shoulders, calves or the like is described. The device has a base which may be supported on a desk, table or floor. A pair of uprights support an upper bar over which one or more rubber bands are placed. This bar is removable when it is desired to change the rubber bands. A hollow lower bar is held between the uprights and the one or more rubber bands pass over this bar. A handle supporting bar is then slid through vertical slots in the uprights and through the center of the lower supporting bar. This provides a light, easily adjusted exercising device which can be easily used by the busy executive or even by bedridden persons.

The patented invention differs from the present invention because the patented invention is a base supported by a desk, table or floor. It comprises a U-shaped base having a cross bar inserted through slots in the two uprights. The cross bar is attached to a resistance means. The patented invention lacks a means of insertion between the mattress and spring of a bed. Further the patented invention lacks the feature of usefulness from a bed. No grip handle and padded loop attachment means is disclosed. The present invention is an exercise device having a base with either two or three holes, spaced closely. An elastic device with two ends is threaded through the holes in such a way that the elastic is not easily pulled through the holes and the end exit on an opposite side of the base, yet allows for easy adjustment. A grip handle is securely attached to one end. A padded loop is securely attached to the other end. The elastic device functions as a variable opposing force to a user. The user places the base of the exercise device between the spring and mattress of a bed to secure it. Straaten, elastic bands extend between anchor points on a bottom bar and pulleys on a top bar. Their free ends are engaged individually or jointly by handles. A brace extends between stretchers spacing the bars apart. By standing on the bottom bar while the apparatus leans against a wall a large number of exercises can be performed by manipulating the handles. The device can be inverted for further exercises or laid flat for further exercises.

The patented invention differs from the present invention because the patented invention is a frame having multiple elastic means attached. The frame is adapted to function in a vertical, horizontal and angled position. The elastic devices are adapted with both a rigid and looped grip on the ends The patented invention may be leaned against a wall or attached to the wall. The invention lacks the feature of small size and cannot be easily placed between the mattress and spring of a bed. It functions with the user out of bed. The patented invention further, has a seat.

In U.S. Pat. No. 4,872,671, titled Exercise Device Providing Varied and Predetermined Resistance, invented by John R. Brandell, an exercising device includes a pair of elongated handles each having an end portion and a gripping portion, with the end portions having an attached rotatable spinner members, with resilient elastic bands attached thereto, and wound together to define a substantially unitary resilient link between the handles interconnects the spinner members and providing a force against the relative movement of the handles with respect to each other to provide an isokinetic exercise device.

The patented invention differs from the present invention because the patented invention is a hand held device lacking the feature of a base. The resistance means is an elastic device.

In U.S. Pat. No. 4,090,706, titled Belt Tension Exerciser, invented by Ronald J. Reda, a belt tension exerciser is provided with a rigid transverse handle which is longitudinally connected to an elastic band or belt to form a closed loop. The effective diameter of the loop measured in the direction of an exercising force may be changed thereby to adjust the expansion in the belt. The handle may be turned on its axis relative to the belt to permit a variety of exercise movements without adjusting one's grip.

The patented invention differs from the present invention because the patented invention is a belt tension exerciser comprising an elastic loop having two grips. The patented invention is adjustable to provide a variable resistance to the user. The patented invention lacks the feature of a base. Further the patented invention is designed to be hand held. The present invention is an exercise device having a base with either two or three holes, spaced closely. A linear elastic device with two ends is threaded through the holes in such a way that the elastic is not easily pulled through the holes and the end exit on an opposite side of the base, yet allows for easy adjustment. A grip handle is securely attached to one end. A padded loop is securely attached to the other end. The elastic device functions as a variable opposing force to a user. The user places the base of the exercise device between the spring and mattress of a bed to secure it.

Numerous innovations for Portable Arm and Leg Exerciser have been provided in the prior art that are adapted to be used. Even though these innovations may be suitable for the specific individual purposes to which they address, they would not be suitable for the purposes of the present invention as heretofore described.

SUMMARY OF THE INVENTION

The present invention is an exercise device having a base with three holes, spaced closely. An elastic device with two ends is intertwined through the three holes in such a way that the elastic device is not easily pulled through the three holes and the end exit on an opposite side of the base, yet allows for easy adjustment. A grip handle is securely attached to one end. A padded loop is securely attached to the other end. The elastic device functions as a variable opposing force to a user. The user places the base of the exercise device between the spring and mattress of a bed to secure it. The resistance of the device is varied by adjusting the length of the elastic member.

The types of problems encountered in the prior art are providing a variable and adjustable resistance to a user.

Further problems encountered in the prior art are providing an exercise device that is simple and easy to use while providing a versatility of exercises for the upper and lower body to a user.

In the prior art, unsuccessful attempts to solve these problems were attempted namely: devices which are complex to use and install. However, the problem was solved by the present invention because the present invention is simple, is easily installed, is versatile, is portable and provides a variable resistance which is also adjustable.

Innovations within the prior art are rapidly being exploited in response to a demand for fitness and exercise equipment.

The present invention solved a long felt need for a portable exercise device that provides a variable resistance and can be used in bed to provide a wide variety of exercises for the upper body and lower body to the user.

Accordingly, it is an object of the present invention to provide an exercise device which has a base which is placed between the spring and mattress of a bed.

More particularly, it is an object of the present invention to provide an exercise device which provides a resistance to the user and is adapted to be used by the user in bed.

In keeping with these objects, and with others which will become apparent hereinafter, one feature of the present invention resides, briefly stated, in a base having an array of holes adapted to accept an elastic device.

When the portable arm and leg exerciser is designed in accordance with the present invention, a simple and effective exercise device results.

In accordance with another feature of the present invention, the base is sufficiently rigid to prevent it from curling under the load from the elastic device.

Another feature of the present invention is that the base has a roughen surface to prevent it from slipping when placed between the spring and mattress of a bed.

Yet another feature of the present invention is that the base has a series of three holes through which the elastic member is intertwined.

Still another feature of the present invention is that three holes are placed in the base in a pattern which prevents the elastic device from slipping, yet allows for easy adjustment.

Yet another feature of the present invention is that the elastic member is adjustable in length.

Still yet another feature of the present invention is that the elastic device has a padded grip on one end.

Another feature of the present invention is that the elastic device has a padded band on one end.

Yet another feature of the present invention is that the elastic device has a padded grip on both ends.

Still another feature of the present invention is that the elastic device has a padded band on both ends.

Yet still another feature of the present invention is that it is sized to easily fit inside a suitcase.

Still yet another feature of the present invention is that a variety of exercises for the upper body and lower body of the user can be performed.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

10—portable arm and leg exerciser (10)
12—board (12)
12U—board upper end (12U)
12B—board bottom end (12B)
12L—board left opening (12L)
12R—board right opening (12R)
12M—board middle opening (12M)
14—exerciser (14)
14A—exerciser elastic member (14A)
14B—exerciser ankle grip (14B)
14C—exerciser hand grip (14C)
16—user (16)
16A—user's arm (16A)
16B—user's leg (16B)
18—bed (18)
18A—bed mattress (18A)
18B—bed box spring (18B)

DESCRIPTION OF THE PREFERRED EMBODIMENT

Figure 1:
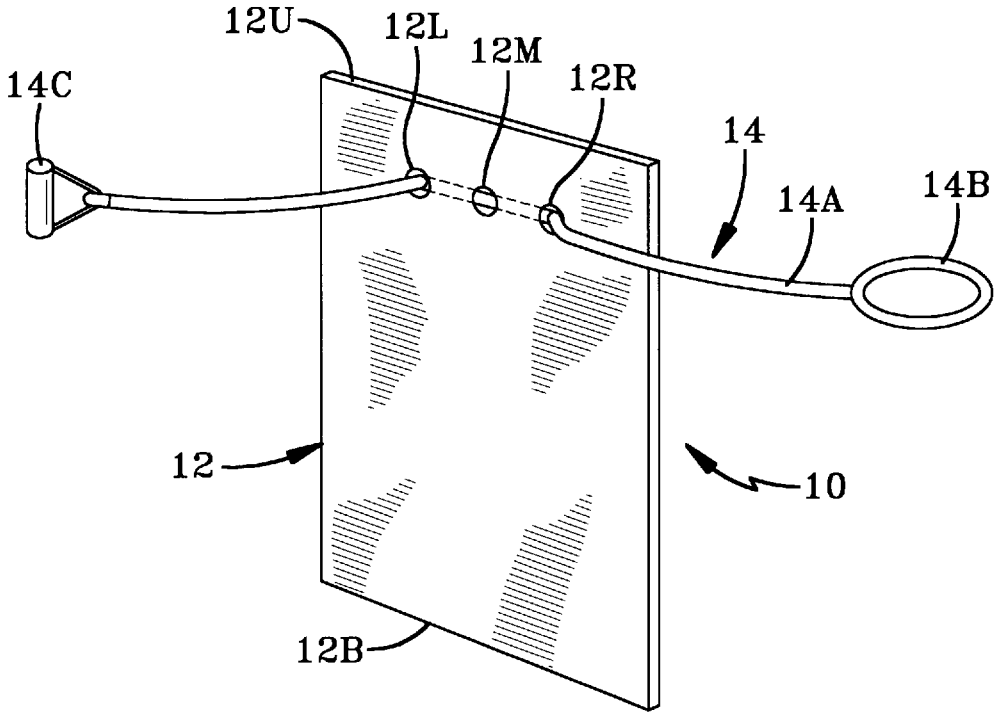
FIG. 1 is a perspective view of a portable arm and leg exerciser showing a first configuration of exerciser.

Firstly, referring to FIG. 1 which is a perspective view of a portable arm and leg exerciser (10). The portable arm and leg exerciser (10) comprises a board (12) which comprises a board upper end (12U) and a board bottom end (12B). The board (12) comprises at least one opening positioned in the board upper end (12U).

The portable arm and leg exerciser (10) further comprises an exerciser (14) which comprises at least one exerciser elastic member (14A) securely fastened on one distal end through the at least one opening to the board (12). The exerciser (14) further comprises an exerciser grip (14B, 14C) fastened to the opposite end of the at least one exerciser elastic member (14A).

The at least one opening of the board (12) consists of a board left opening (12L), a board right opening (12R) and a board middle opening (12M). In a first stringing configuration the exerciser elastic member (14A) is slidably positioned up through the board left opening (12L) and down through the board right opening (12R). This configuration secures the exerciser elastic member (14A) to the board (12), yet allows for easy adjustment. The exerciser elastic member (14A) comprises a first exerciser grip (14B, 14C) on one distal end and a second exerciser grip (14B, 14C) on the opposite distal end.

The board (12) is constructed from a material consisting of wood, wood composite, metal, metal alloy, plastic, plastic composite, rubber composite, fiberglass, epoxy and carbon-graphite.

The exerciser elastic member (14A) is selected from a group consisting of rubber, rubber composite, bungee, and spring.

Figure 2:
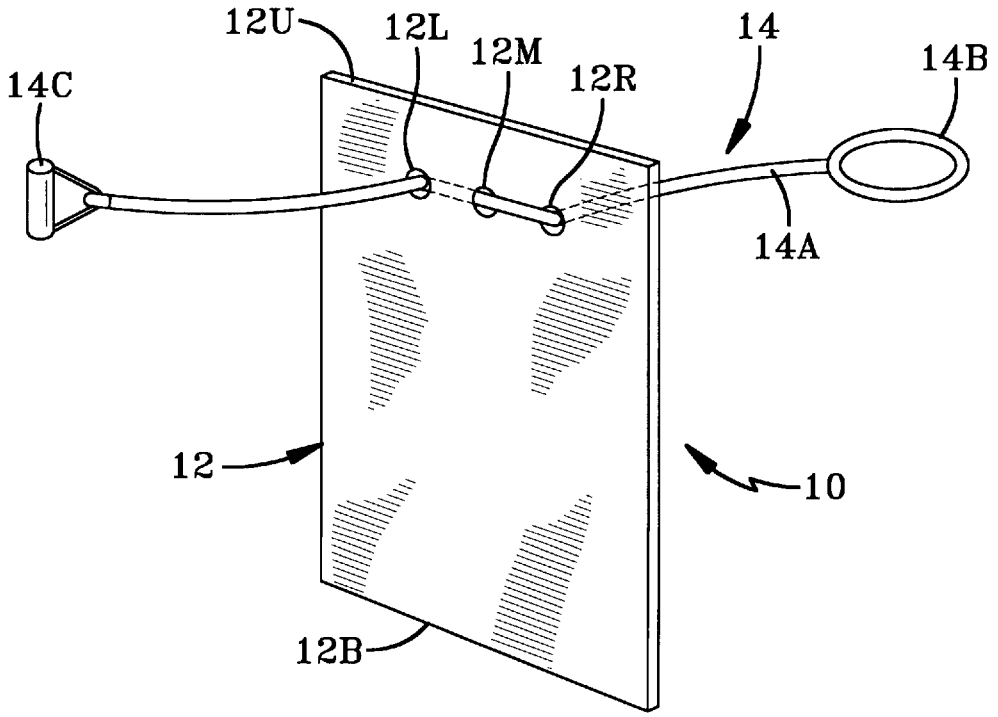
FIG. 2 is a perspective view of a portable arm and leg exerciser showing a second configuration of exerciser.

Secondly, referring to FIG. 2 which is a perspective view of the portable arm and leg exerciser (10) showing a second configuration of the exerciser (14). The portable arm and leg exerciser (10) comprises the board (12) which comprises the board upper end (12U) and the board bottom end (12B). The board (12) comprises at least one opening positioned in the board upper end (12U).

The portable arm and leg exerciser (10) further comprises the exerciser (14) which comprises at least one exerciser elastic member (14A) securely fastened on one distal end through the at least one opening to the board (12).

The at least one opening of the board (12) consists of a board left opening (12L), a board right opening (12R) and a board middle opening (12M). In a second stringing configuration the exerciser elastic member (14A) is slidably positioned up through the board left opening (12L) and down through the board middle opening (12M) and up through the board right opening (12R). The second stringing configuration further secures the exerciser elastic member (14A) to the board (12), yet still allows for easy adjustment. The exerciser elastic member (14A) further comprises a first exerciser grip (14B, 14C) on one distal end and a second exerciser grip (14B, 14C) on the opposite distal end.

Figure 3:
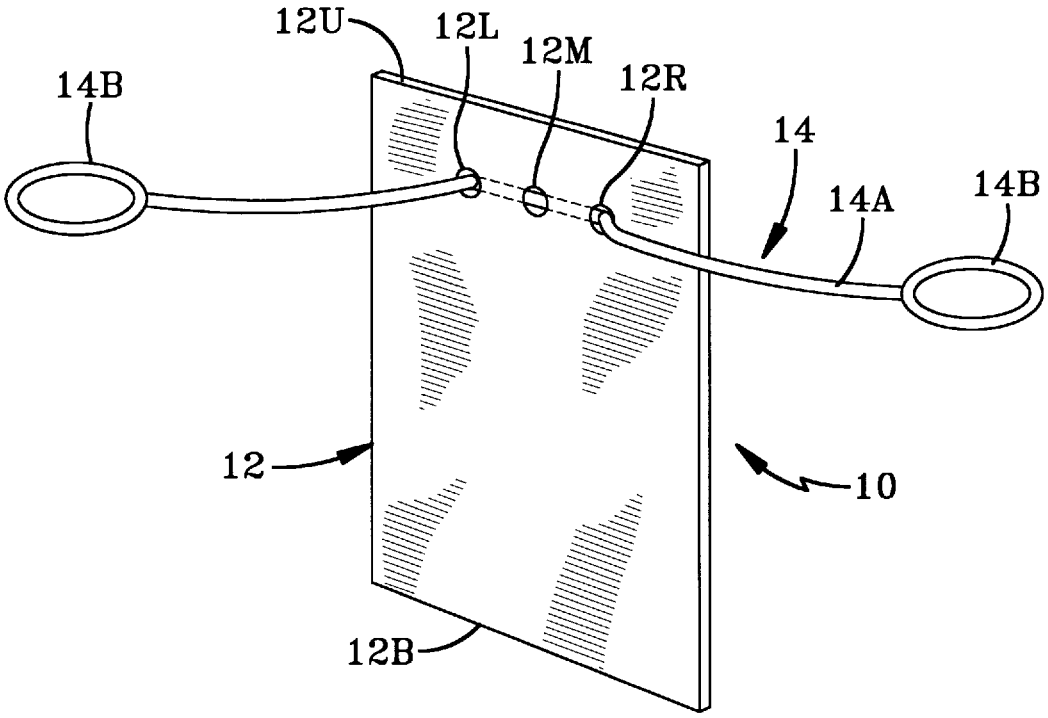
FIG. 3 is a perspective view of a portable arm and leg exerciser showing a third configuration of exerciser.

Now referring to FIG. 3 which is a perspective view of a portable arm and leg exerciser showing a third configuration of the exerciser (14). The portable arm and leg exerciser (10) comprises the board (12) which comprises the board upper end (12U) and the board bottom end (12B). The board (12) comprises at least one opening positioned in the board upper end (12U).

The portable arm and leg exerciser (10) further comprises an exerciser (14) which comprises at least one exerciser elastic member (14A) securely fastened on one distal end through the at least one opening of the board (12).

The at least one opening of the board (12) consists of a board left opening (12L), a board right opening (12R) and a board middle opening (12M). The exerciser elastic member (14A) is slidably positioned up through the board left opening (12L) and down through the board right opening (12R) which secures the elastic member (14A) to the board (12), yet allows for easy adjustment. The exerciser elastic member (14A) further comprises a first exerciser grip (14B) on one distal end and a second exerciser grip (14B) on the opposite distal end.

Figure 4:
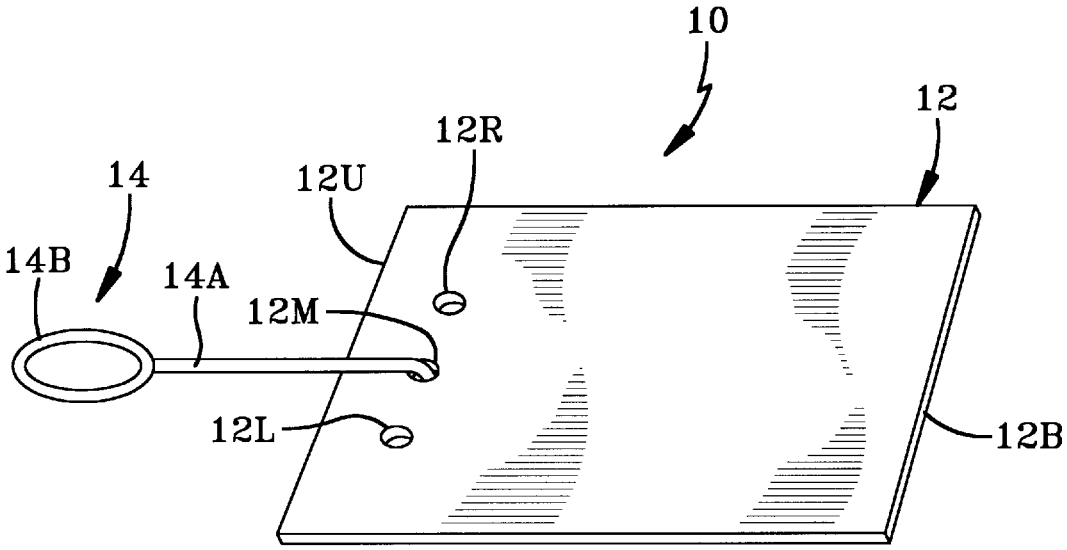
FIG. 4 is a perspective view of a portable arm and leg exerciser showing a fourth configuration of exerciser.

Now referring to FIG. 4 which is a perspective view of a portable arm and leg exerciser (10) showing a fourth configuration of the exerciser (14). The portable arm and leg exerciser (10) comprises the board (12) which comprises the board upper end (12U) and the board bottom end (12B). The board (12) comprises at least one opening positioned in the board upper end (12U).

The at least one opening of the board (12) consists of a board left opening (12L), a board right opening (12R) and a board middle opening (12M). The board (12) further comprises an exerciser (14) which comprises at least one exerciser elastic member (14A). The exerciser elastic member (14A) is securely fastened on one distal end through the board middle opening (12M). The exerciser elastic member (14A) further comprises an exerciser grip (14B) on the opposite distal end.

Figure 5:
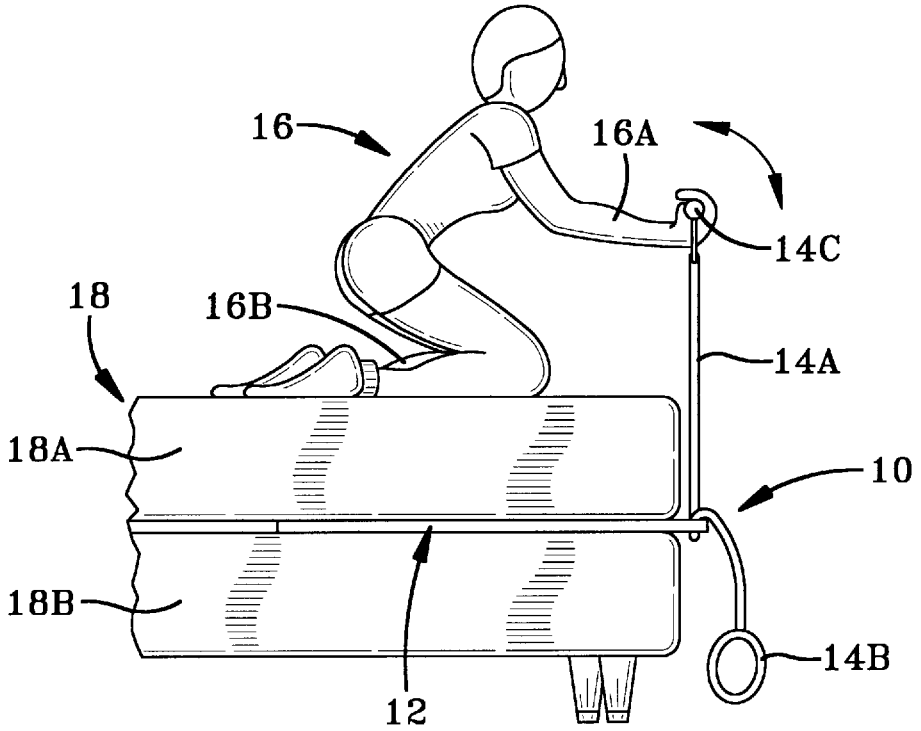
FIG. 5 is a perspective view of a portable arm and leg exerciser showing a fifth configuration of exerciser.
Figure 6:
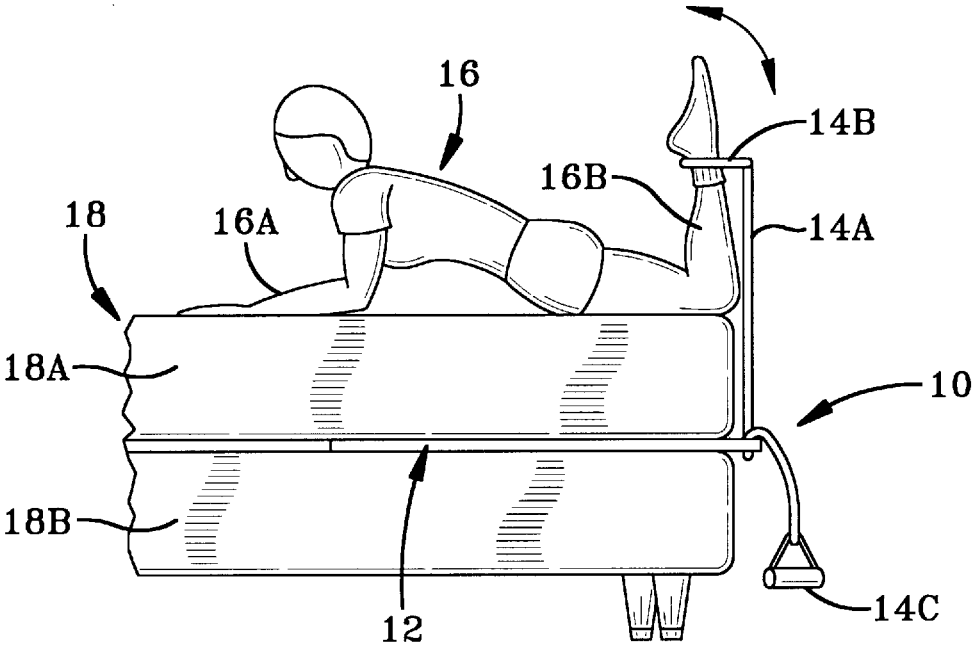
FIG. 6 is a perspective view of a portable arm and leg exerciser showing a sixth configuration of exerciser.

Now referring to FIG. 5 and FIG. 6 which are side views of a portable arm and leg exerciser (10) showing a between mattress installation. The portable arm and leg exerciser (10) comprises a board (12). The portable arm and leg exerciser (10) further comprises an exerciser (14) which comprises at least one exerciser elastic member (14A) securely fastened on one distal end through the at least one opening in the board (12). The exerciser (14) further comprises an exerciser grip (14B, 14C) fastened to the opposite end of the at least one exerciser elastic member (14A). A user (16) inserts the board (12) between a bed mattress (18A) and a bed box spring (18B) of a bed (18). To exercise a user's arm and upper body (16A), the user (16) sits on the bed mattress (18A) over the board (12) and securely holds an exerciser hand grip (14C) moving in an upward direction to tension the exerciser elastic member (14A) and moving in a downward direction to release tension from the exerciser elastic member (14A). To exercise a user's leg and lower body (16B), the user (16) lays down on the bed mattress (18A) over the board (12) and securely affixes an exerciser ankle grip (14B) moving in an upward direction to tension the exerciser elastic member (14A) and moving in a downward direction to release tension from the exerciser elastic member (14A).

It will be understood that each of the elements described above, or two or more together, may also find a useful application in other types of constructions differing from the type described above.

While the invention has been illustrated and described as embodied in a Portable Arm and Leg Exerciser, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A portable arm and leg exerciser comprising:

a board comprising a board upper end and a board bottom end and a pair of sides connecting the board upper end to the board bottom end, the board having a top surface and a lower surface and at least one opening positioned in the board upper end located between the pair of sides and extending through the board from the top surface to the lower surface;

an exerciser comprising at least one exerciser elastic member securely fastened on one distal end through the at least one opening to the board, each of the at least one opening dimensioned for receiving and holding the elastic member slidably therethrough, the exerciser further comprising an exerciser grip fastened to the opposite end of the at least one exerciser elastic member, wherein a user inserts the board bottom end of the board between a bed mattress and a bed box spring of a bed leaving the board top end and the at least one opening extending out from the board mattress and the bed box spring, for access to the exerciser grip, to exercise a user's arm and upper body, and to exercise a user's leg and lower body.

2. The portable arm and leg exerciser as described in claim 1, wherein the at least one opening of the board consists of a board left opening and a board right opening, the exerciser elastic member (14A) is slidably positioned therethrough, the exerciser elastic member comprises a first exerciser grip on one distal end and a second exerciser grip on the opposite distal end.

3. The portable arm and leg exerciser as described in claim 1, wherein the at least one opening of the board comprises a board left opening, a board right opening and a board middle opening, the exerciser elastic member being slidably positioned up through the board left opening and down through the board middle opening and up through the board right opening, and the exerciser elastic member comprises a first exerciser grip on one distal end and a second exerciser grip on the opposite distal end.

4. The portable arm and leg exerciser as described in claim 1, wherein the at least one opening of the board comprises a board middle opening located generally equidistant from both sides, the exerciser elastic member being securely fastened on one distal end through the board middle opening and comprising an exerciser grip on the opposite distal end.

5. The portable arm and leg exerciser as described in claim 1, wherein the board is constructed from a material consisting of wood, wood composite, metal, metal alloy, plastic, plastic composite, rubber composite, fiberglass, epoxy and carbon-graphite.

6. The portable arm and leg exerciser as described in claim 1, wherein the exerciser elastic member (14A) is selected from a group consisting of rubber, rubber composite, bungee, and spring.

7. The portable arm and leg exerciser as described in claim 1, wherein the at least one opening is a circular opening.

8. The portable arm and leg exerciser as described in claim 2, wherein the left opening and the right opening are aligned with one another running parallel to the top of the board.

9. The portable arm and leg exerciser as described in claim 8, wherein the board left opening and the board right opening are closely spaced circular openings.

10. The portable arm and leg exerciser as described in claim 2, wherein the board left opening and the board right opening are circular openings.

11. The portable arm and leg exerciser as described in claim 3, wherein the board left opening, the board right opening, and the board middle opening are aligned with one another running parallel to the top of the board.

12. The portable arm and leg exerciser as described in claim 11, wherein the board left opening, the board right opening, and the board middle opening are closely spaced circular openings.

13. The portable arm and leg exerciser as described in claim 3, wherein the board left opening, the board right opening, and the board middle opening are circular openings.

14. The portable arm and leg exerciser as described in claim 4, wherein the board middle opening is a circular opening.

* * * * *